US005533282A

United States Patent [19]

Kataoka et al.

[11] Patent Number: 5,533,282

[45] Date of Patent: Jul. 9, 1996

[54] HARD PLATE OF EACH OF SPIKE SHOES FOR FIELD AND TRACK EVENTS

[75] Inventors: Akira Kataoka, Kobe; Hitoshi Mimura, Kakogawa; Manabu Kuramoto; Ryuichi Tukita, both of Kobe, all of Japan

[73] Assignee: ASICS Corporation, Hyogen-ken, Japan

[21] Appl. No.: 388,263

[22] Filed: Feb. 13, 1995

[30] Foreign Application Priority Data

Feb. 17, 1994 [JP] Japan ..... 6-059773

[51] Int. Cl.[6] ..... A43B 5/00; A43B 5/06

[52] U.S. Cl. ..... 36/129; 36/28; 36/134; 36/67 R

[58] Field of Search ..... 36/28, 59 R, 67 R, 36/67 A, 67 D, 114, 129, 134

[56] References Cited

U.S. PATENT DOCUMENTS

| | | | |
|---|---|---|---|
| 1,072,794 | 9/1913 | Tradesco | 36/134 X |
| 2,677,905 | 5/1954 | Dye | 36/134 X |
| 3,043,026 | 7/1962 | Semon | 36/134 X |
| 4,202,116 | 5/1980 | Dassler | 36/59 R |
| 4,212,120 | 7/1980 | Bowerman et al. | 36/129 |
| 4,361,971 | 12/1982 | Bowerman | 36/129 |
| 4,507,879 | 4/1985 | Dassler | 36/28 X |
| 4,546,559 | 10/1985 | Dassler | 36/129 |
| 5,029,405 | 7/1991 | DeHaitre | 36/67 D X |

FOREIGN PATENT DOCUMENTS

| | | | |
|---|---|---|---|
| 4223167 | 8/1993 | Germany | 36/129 |

*Primary Examiner*—Paul T. Sewell
*Assistant Examiner*—Marie D. Patterson
*Attorney, Agent, or Firm*—Nixon & Vanderhye

[57] ABSTRACT

A shoe part for running shoes for field and track events wherein each shoe has a sole, a hard plate for a forefoot portion of the shoe sole, including a plurality of columnar projections and a plurality of shorter projecting portions terminating short of the columnar projections on a surface side of the hard plate. The hard plate includes an elastic region projecting from adjacent surrounding surfaces of the hard plate and lying in a central region of the surface side of the hard plate at which maximum compressive load is applied during running.

16 Claims, 5 Drawing Sheets

HARD PLATE OF EACH OF SPIKE SHOES FOR FIELD AND TRACK EVENTS

BACKGROUND OF THE INVENTION

1. Field of the Invention

The present invention relates to a hard plate for spike shoes for field and track events used in a short distance.

2. Description of the Related Art

A hard plate made of synthetic resin is mounted to a forefoot portion of a sole on each shoe of a pair of spike shoes for field and track events, on an all-weather type track. Eleven spikes or less prescribed, as a general rule for field and track meets, are detachably attached onto a surface side of this hard plate and many projecting portions are integrally formed on this surface side.

As shown in FIG. 1, a surface 20*a* of a hard plate 20 of this type is normally formed approximately in a flat shape. Spike attaching portions 30 are projected and formed by the same material as this surface 20*a* as a reference face.

A female screw member is buried in each of the spike attaching portions 30 such that a height H1 from the reference face is set to about 2 to 3 mm. A spike 9 is screwed into this female screw member and is fixed thereto such that a length L2 of the spike 9 is equal to or smaller than 9 mm. Each of these spike attaching portions 30 has a flat top face 30*a*. Projecting portions 40 are projected on this entire top face 30*a* and the entire surface 20*a* and are spaced from each other at suitable distances such that a length L1 of each of the projecting portions 40 is equal to or smaller than 5 mm.

A sharpened end tip of each of the projecting portions 40 has approximately the same height and is lower than an end tip of the spike 9 by a few mm. Accordingly, when a forefoot portion of a runner comes in contact with a road surface of a track while running, a slip-proof property and a road surface gripping force are manifested so that running speed is increased.

In the above described general hard plate 20, many projecting portions 40 are formed on the entire top face 30*a* of each of the spike attaching portions 30 formed in a flat shape and the entire surface 20*a* of the hard plate 20. End tips of these projecting portions 40 are formed in a shape such as a frog in a flower arrangement (Ikebana in Japan).

When the hard plate 20 lands on the road surface, the hard plate 20 attains a state in which the hard plate 20 presses against the frog. Accordingly, pressure, when the foot lands is dispersed to the entire hard plate 20. Thus, no vertical load is concentrated in a central region of the forefoot portion and the force pressing against the road surface is reduced. Therefore, repulsive force from the road surface to a side of the hard plate 20, i.e., elastic force of the hard plate 20 itself is reduced so that no force for kicking the road surface can be sufficiently increased. Accordingly, there is a limit in an increase in to running speed when this general hard plate 20 is used.

The projecting portions 40 are projected from the respective top faces 30*a* of the spike attaching portions 30 by a few mm. When the forefoot position, i.e., the trampling portion of the hard plate 20 comes in contact with the road surface of a track in landing and each of the flat top faces 30*a* attains a landing state, further depression of the end tips of the projecting portions 40 into the road surface is prevented. Accordingly, the many projecting portions 40 insufficiently depress the road surface so that the slip-proof property and the road surface gripping force of the shoes are reduced. Therefore, running speed equal to or higher than a constant running speed cannot be obtained as a result of using this general hard plate.

SUMMARY OF THE INVENTION

It is therefore an object of the present invention to provide a hard plate for each shoe of a pair of spike shoes for field and track events for improving running movement by increasing elastic forces upon landing time of a forefoot portion thereof so that running speed can be increased.

In accordance with a first construction of the present invention, the above object can be achieved by a hard plate of each of spike shoes for field and track events having a forefoot portion of a shoe sole which is constructed by projectively arranging a plurality of columnar projections and many projecting portions shorter than these columnar projections on a surface side of the hard plate; the hard plate comprising an elastic region swelling out and higher than another surface region by approximately rising a center of the surface side.

In accordance with a second construction of the present invention, the above object can be also achieved by a hard plate of each of spike shoes for field and track events having a forefoot portion of a shoe sole which is constructed by projectively arranging a plurality of columnar projections and many projecting portions shorter than these columnar projections on a surface side of the hard plate; the hard plate comprising an elastic region swelling out and higher than another surface region by approximately rising a center of the surface side; and a columnar projection attaching portion swelling out and higher than another surface region by rising the surface side in an angular shape such that each of the columnar projections is attached to a top portion of the columnar projection attaching portion.

In the first construction of the present invention, when a forefoot portion of a runner lands on a road surface during a running movement of the runner, the elastic region swelling out and higher than another surface region is arranged approximately on a surface side of a center of the hard plate to which strongest force is applied.

Accordingly, when the hard plate lands on the road surface at a time of the running movement, the swelling-out elastic region lands on the road surface prior to another surface region so that a load is concentrated to this elastic region and force for pressing against the road surface is strengthened. Thus, repulsive force from the road surface is applied to the hard plate by greatly deforming the road surface when the hard plate is separated from the road surface. Therefore, high elastic force is generated in the elastic region in comparison with another surface region so that force for kicking the road surface is increased. Thrust for making the runner push out in a progressing direction is increased by this increase in kicking force.

In the second construction of the present invention, when a forefoot portion of a runner lands on a road surface during a running movement of the runner, the elastic region swelling out and higher than another surface region is approximately arranged on a surface side of a center of the hard plate to which strongest force is applied. Similarly, the columnar projection attaching portion attaching each of the columnar projections thereto rises and swells out and is formed in an angular shape such that this columnar projection attaching portion is higher than another surface region.

Accordingly, when the hard plate lands on the road surface at a time of the running movement, the elastic region lands on the road surface prior to another surface region so that a load is concentrated to this elastic region and force for pressing against the road surface is strengthened. Therefore, high elastic force is generated in the elastic region in comparison with another surface region so that force for kicking the road surface is increased. Thrust for making the runner push out in a progressing direction is increased by this increase in kicking force.

The columnar projection attaching portion swells out and is formed in an angular shape. Accordingly, when an end tip of each of the projecting portions depresses the road surface, it is possible to avoid a situation in which a depressing movement of this end tip is prevented by this swelling-out columnar projection attaching portion. Therefore, a slip-proof property and a road surface gripping force can be sufficiently secured.

Further objects and advantages of the present invention will be apparent from the following description of the preferred embodiments of the present invention as illustrated in the accompanying drawings.

DESCRIPTION OF THE PREFERRED EMBODIMENTS

Figure 1:
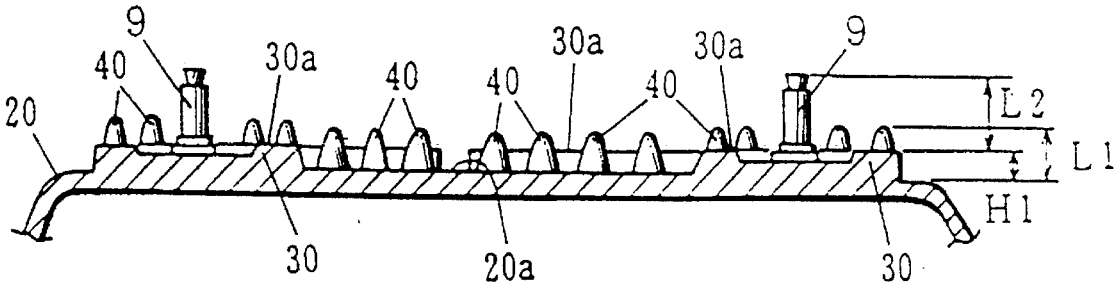
FIG. 1 is a transverse cross-sectional view showing a general hard plate for a shoe of a pair of spike shoes for field and track events in accordance with the prior art.

The preferred embodiments of a hard plate of each shoe of a pair of spike shoes for field and track events in the present invention will next be described in detail with reference to the accompanying drawings.

The spike shoes for field and track events are used for short distance races. A hard plate 2 constituting a forefoot portion 1*a* is mounted onto a shoe sole 1 and is made of synthetic resin. An elastic region 3, spike attaching portions 4 to 8 and many projecting portions 12 are integrally formed in the hard plate 2. A plurality of spikes (columnar projections) 9 are attached to this hard plate 2.

The hard plate 2 is approximately formed in a flat shape on the side of a surface 2*a* thereof. The hard plate 2 rises in six portions thereof with this surface 2*a* as a reference face so that the elastic region 3 and the spike attaching portions 4 to 8 swell out and are projected outward.

The elastic region 3 is approximately formed on a central portion of the surface 2*a* as a trampling portion 2*b* to which the largest load is applied when the hard plate 2 lands and comes in contact with a road surface while running. This is because it is apparent from analyzed results of the magnitude of force at a contact point of the road surface that a maximum elastic force is caused as repulsive force with respect to a load when there is a center of gravity in a constant region between a middle toe joint and a toenail tip 2*d*.

In this embodiment, a thickness of the hard plate 2 on the side of the surface 2*a* is increased to such an extent that problems and a feeling of physical disorder are not caused in the running movement. Namely, a maximum height H of a rising portion of the hard plate 2 swelling out and higher than another surface region 2*c* is set to about 4 mm so that the rising portion is approximately formed in an elliptical shape as a plan view.

In a more detailed structure of the hard plate, a distance from an intersecting point P to a toenail tip 2*d* is divided into nine equal parts. The intersecting point P is formed by intersecting a central line C along a longitudinal direction of the hard plate 2 with a straight line connecting a point M1 on the side of a thenar eminence 1*b* and a point M2 on the side of a little toe eminence 1*c* in the forefoot portion 1*a*. A longitudinal width W1 is set to the remaining 5/9 of the nine equal parts from a side of the toenail tip 2*d*. Further, a distance between an inside portion located at the point M1 and an outside portion located at the point M2 is divided into three equal parts. A transversal width W2 is set to the central remaining 1/3 of the three equal parts obtained by removing 1/3 of the three equal parts from the inside portion and 1/3 of the three equal parts from the outside portion.

The above spike attaching portions 4 to 8 are formed in five positions corresponding to fixed positions of spikes 9. The spike attaching portions 4 to 8 rise in an angular shape such that a height H of each of the spike attaching portions 4 to 8 from the reference face is equal to about 2 to 3 mm. The three spike attaching portions 4 to 6 on a front side near the toenail tip 2*d* are approximately formed in a circular shape and the two spike attaching portions 7 and 8 on a rear side are approximately formed in an elliptical shape.

An inclination angle of each of these spike attaching portions 4 to 8 is preferably set to be large as much as possible with each of inclination faces of the spike attaching portions 4 to 8 as a gentle curved surface or a flat surface.

A female screw member is buried in each of the spike attaching portions 4 to 8. A spike having 9 mm in length L is fixed to the female screw member of each of the spike attaching portions 4 to 5. A flange type spike 10 is fixed to the female screw member of each of the spike attaching portions 7 and 8. This flange type spike 10 is formed in a three-forked shape in which flanges 10*a* are branched at an equal distance. Spikes 9 are projected in respective corner portions to improve a road surface gripping force and a slip-proof property. An attaching screw is screwed into the flange type spike 10 through a screw hole formed at a center of the flanges 10*a* so that the flange type spike 10 is fixed to the female screw member.

A female screw member is buried on the side of the toenail tip 2*d* without rising to each of the spike attaching portions. A V-shaped spike 11 is fixed onto this female screw member. This V-shaped spike 11 is formed by projecting spikes 9 in end portions of a V-shaped metal fitting 11*a*.

Each of the projecting portions 12 is approximately formed in a triangular conical shape and is gently inclined on a front side. The projecting portions 12 are spaced from each other at suitable distances and are integrally projected on the entire surface 2*a* such that a length L of each of the projecting portions 12 is equal to or smaller than 5 mm.

When the hard plate 2 comes in contact with a road surface during the running movement of a runner, sharpened end tips of the projecting portions 12 attain a depressing state so that the slip-proof property is improved. Further, each of the projecting portions 12 itself has elasticity so that elastic force caused at a contact or landing time can be increased together with the elastic region 3 and the spike attaching portions 4 to 8 swelling out.

Figure 3:
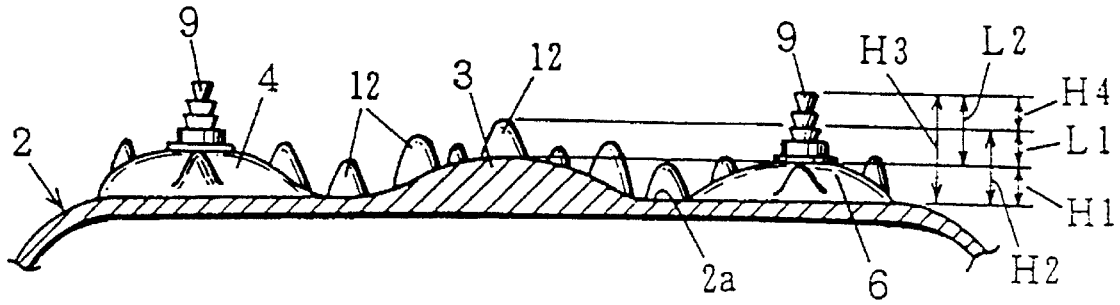
FIG. 3 is a transverse cross-sectional view of the hard plate taken along line II—II of FIG. 2.

As shown in FIG. 3, the hard plate 2 is formed such that a swelling-out height H1 of the elastic region 3 is equal to about 4 mm and a length L1 of each of the projecting portions 12 is equal to 5 mm. Accordingly, a total height H2 is equal to 9 mm. On the other hand, a swelling-out height H1 of each of the spike attaching portions 4 to 8 is equal to about 4 mm and a length L2 of each of the spikes 9 is equal to 9 mm. Therefore, a total height H3 until an end tip of each of the spikes 9 is equal to 13 mm.

Accordingly, a height difference H4 between each of the spikes 9 and a highest projecting portion 12 formed in the elastic region 3 is secured as about 4 mm. Therefore, when the spikes 9 land on the road surface, the spikes depress the road surface without any problems so that the road surface gripping force and the slip-proof property obtained by these spikes 9 are not reduced.

Each of the spike attaching portions 4 to 8 also swells out on a gentle inclination face. Accordingly, when the hard plate 2 lands on the road surface, the road surface is compressed and deformed by a load approximately until the same level as low projecting portions 12 projected on a side of another surface region 2*c*. Accordingly, it is possible to solve problems of the general hard plate in which movements of these low projecting portions are prevented by top portions of the spike attaching portions 4 to 8 so that the low projecting portions cannot sufficiently land on the road surface. Thus, the road surface gripping force and the slip-proof property can be reliably shown.

A test of each shoe of the pair of spike shoes for field and track events having the above hard plate will next be explained. In this test, a generally well-known force plate and a microcomputer are used. Each of the spike shoes is measured and analyzed by arranging the force plate on the road surface of a track.

Figure 2:
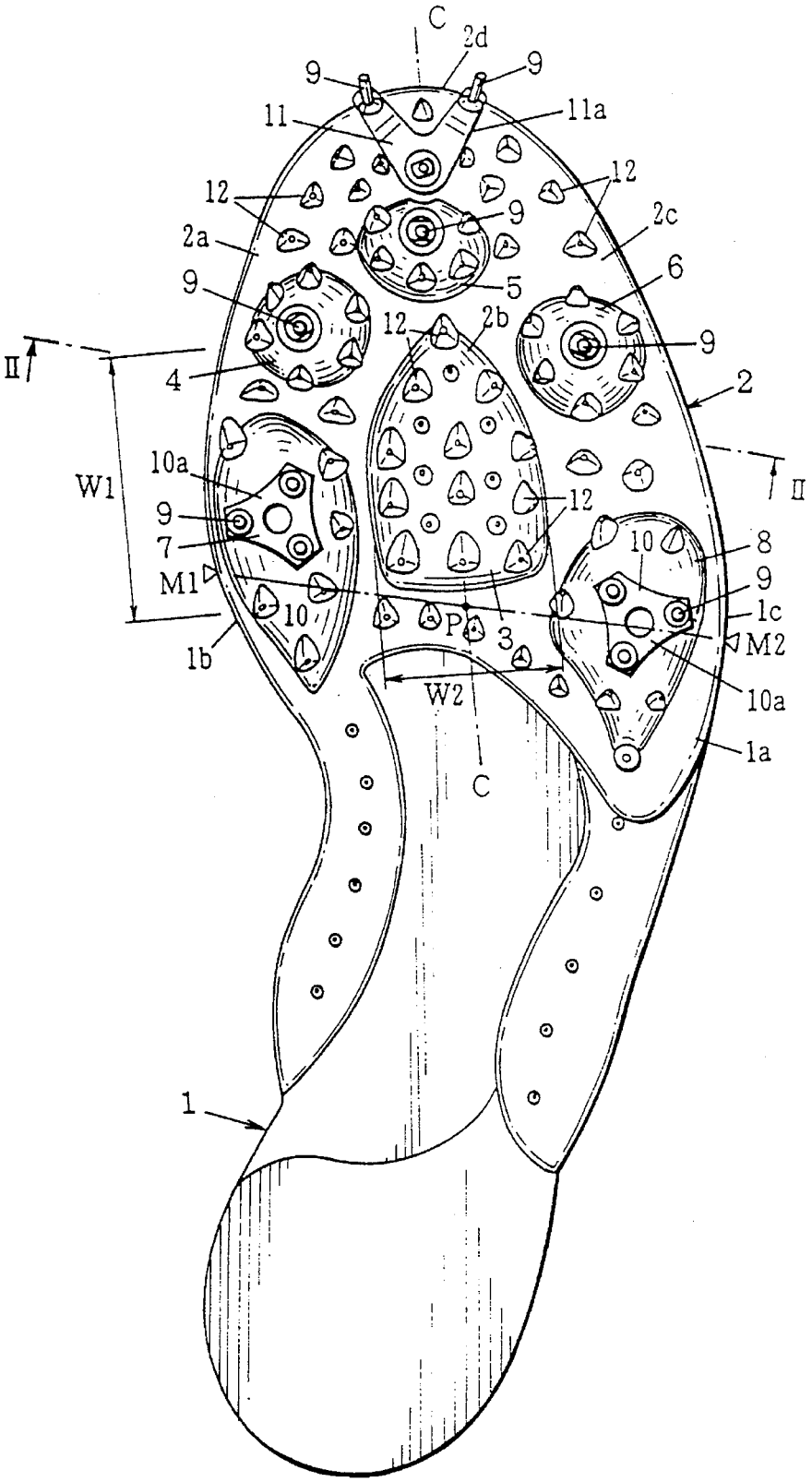
FIG. 2 is a plan view showing a hard plate for a shoe of a pair of spike shoes for field and track events in accordance with one embodiment of the present invention and seen from a surface side.

In this force plate, a pressure detecting sensor is arranged at each of a rectangular plate although this pressure detecting sensor is omitted in FIGS. 2 and 3. An output of this pressure detecting sensor is amplified by an amplifier. Thereafter, the amplified output is A/D-converted by an A/D converter and is transmitted to a microcomputer.

This microcomputer receives a detecting signal from the force plate and performs predetermined processings in which measured results with respect to an added load are shown by a straight line and a curve in a simulation of the hard plate 2. Further, the microcomputer performs a control operation for recording a magnitude and a direction of the added load, etc. on a sheet of recording paper.

Figure 4:
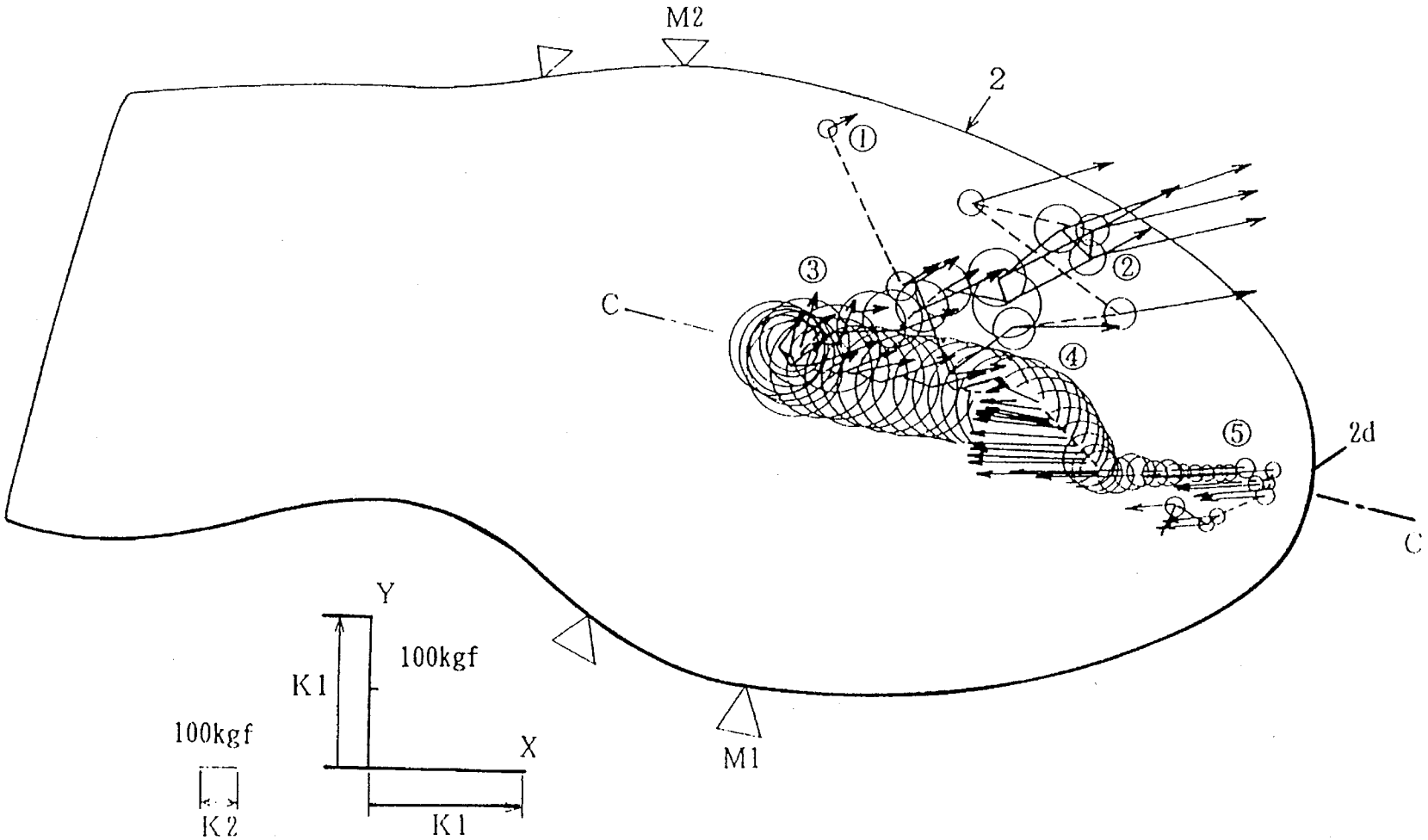
FIG. 4 is an explanatory view showing load experimental data of the hard plate hereof.

FIG. 4 shows these test results. In FIG. 4, an X-axis is set to a longitudinal direction along a central line C—C of the hard plate 2. A Y-axis is set to a width direction perpendicular to this central line C—C. An arrow of a right-hand direction shown in FIG. 4 shows a horizontal load at X and Y coordinates and the length of a straight line of this arrow shows a magnitude of this load with K1 and 100 Kgf at the X and Y coordinates. A circular shape shows a vertical load and a diameter of this circle shows a magnitude of this load with length K2 as 100 Kgf.

The hard plate 2 comes in contact with the road surface near a little toe eminence 1*c* of ① and an outside portion of the hard plate 2 sequentially lands on the road surface during the running movement of a runner. As this outside portion sequentially lands, a center of gravity of the runner is moved and a horizontal load becomes maximum in a returning position of ②. When the center of gravity moves as the trampling portion moves toward a central side of ③, the vertical load is gradually increased and becomes maximum in a position near a center of the hard plate having the elastic region 3. Accordingly, it should be understood that elastic force is most strongly applied to the hard plate in this position.

When the center of gravity moves from ③ to the side of a toenail tip 2*d* by a kick, the vertical load is gradually reduced near ④. A horizontal load and the vertical load become zero by separating the hard plate from the road surface in position ⑤ on a side of the toenail tip 2*d*.

As can be clearly seen from these test data, the elastic region 3 having high elastic is approximately formed in the center of the hard plate 2 to which the vertical load is concentratedly applied. Accordingly, when the hard plate 2 lands on the road surface at the time of the running movement, the elastic region 3 lands on the road surface prior to another surface region 2*c*.

Thus, the loads are concentrated to this elastic region 3 so that force pressing against the road surface is strengthened. Therefore, high elastic force is generated in the elastic region 3 in comparison with another surface region 2*c* so that force for kicking the road surface is increased. Thus, thrust for making the runner push out in a progressing direction is increased.

In addition to this, pulling speeds the runner's legs are increased and the runner's staying time in the air is increased. Accordingly, a running speed can be greatly increased in comparison with each of general spike shoes for field and track events in which such an elastic region 3 is not formed.

Figure 5:
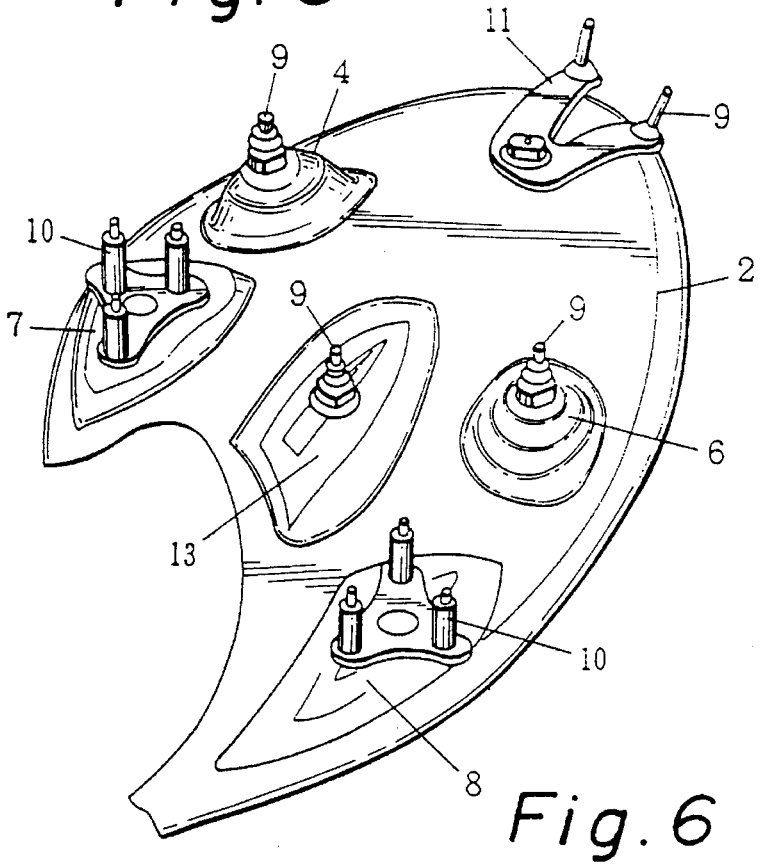
FIG. 5 is a perspective view showing a hard plate according to another embodiment of the present invention on a surface side thereof.

As shown in FIG. 5, each of the spike attaching portions 4 to 8 swells out and is projected in an angular shape. Accordingly, as mentioned above, when an end tip of each of the projecting portions 12 depresses the road surface, no movement of this end tip is prevented by a spike attaching portion 13 and the slip-proof property and the road surface gripping force are not reduced. Therefore, the running speed is further increased in addition to the above effects of the elastic region 3.

In the above embodiment, the elastic region 3 is approximately formed in the center of the hard plate 2. However, the hard plate 2 may be constructed such that this elastic region 3 is set to a spike attaching portion 13, and a female screw member is buried as shown in FIG. 5, and each of the above spikes 9 is screwed and fixed into this female screw member. In this hard plate 2, the spike attaching portion 13 also functions as the elastic region 3. Accordingly, force for approximately kicking the road surface in the center of the hard plate 2 is increased and the road surface gripping force is increased so that this structure contributes to the increase in running speed.

Figure 6:
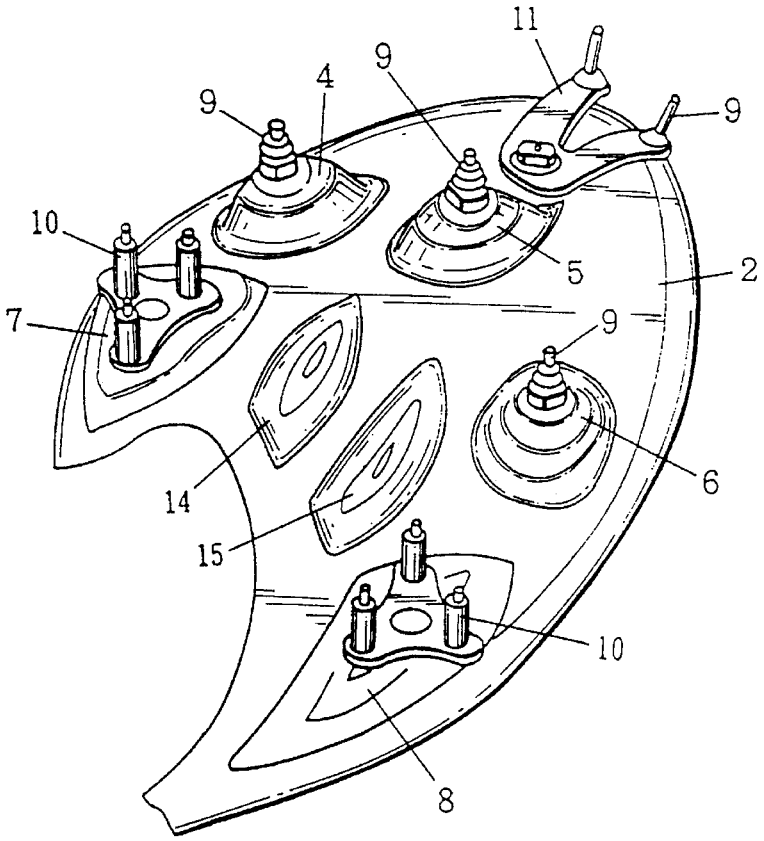
FIG. 6 is a perspective view showing a hard plate as one modified example on a surface side thereof.
Figure 7:
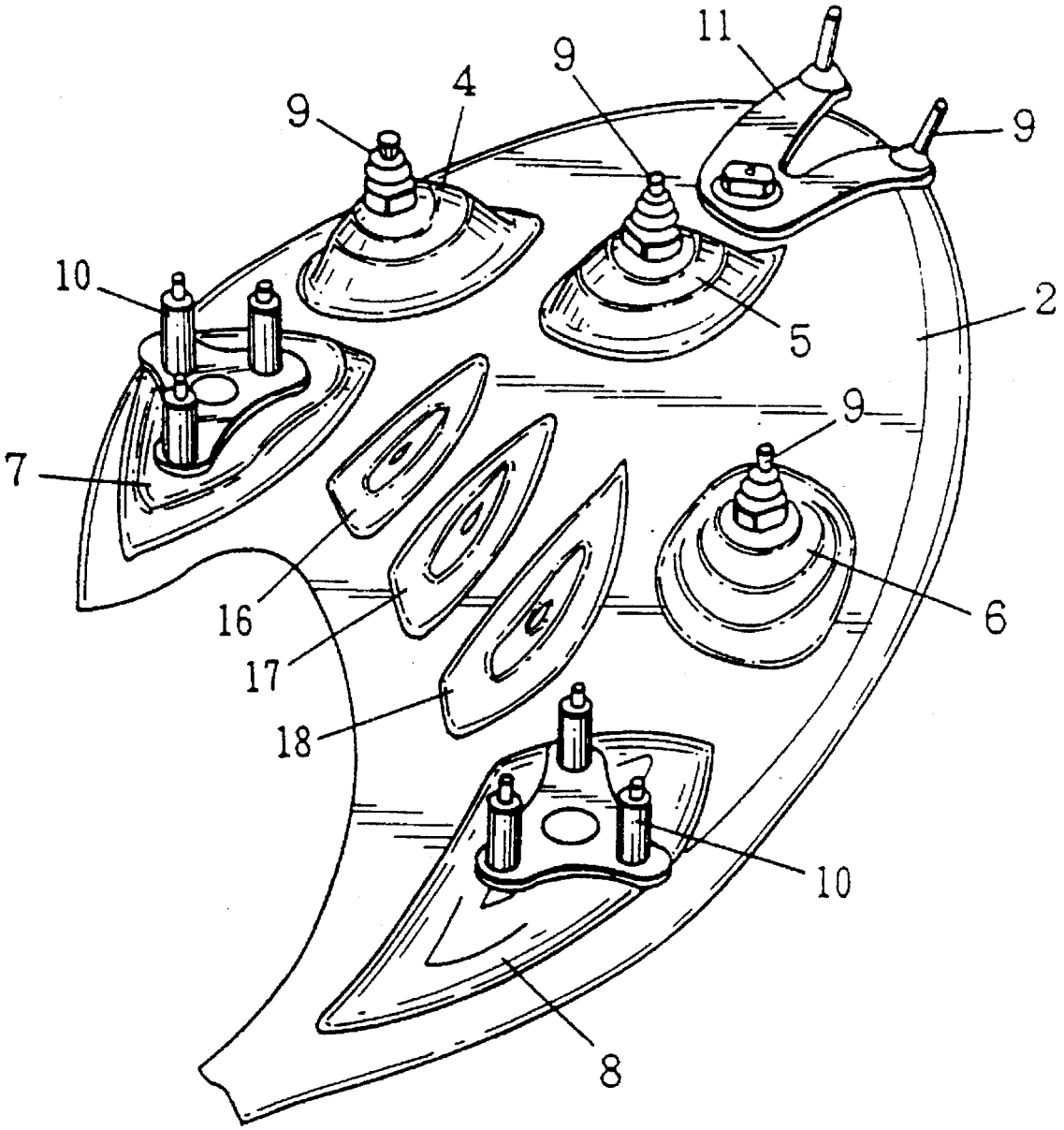
FIG. 7 is a perspective view showing a hard plate as another modified example on a surface side thereof.

As shown in FIG. 6, two elastic regions 14 and 15 may be approximately formed in two positions in the center of the hard plate 2. Otherwise, as shown in FIG. 7, three elastic regions 16, 17 and 18 may be approximately formed in three positions in the center of the hard plate 2. In these cases, effects similar to those in each of the above embodiments can be obtained.

As mentioned above, in a first construction of the present invention, an elastic region is formed such that the elastic region highly rises approximately in the center of a hard plate on its surface side on which a strong load is applied to the hard plate during running movement. Accordingly, when a forefoot portion lands on a road surface, strong elastic force is concentratedly applied to this elastic region so that force for kicking the road surface is increased. Accordingly, this force becomes thrust for making a runner's body strongly push out in a progressing direction. Further, pulling speeds of legs are increased and a staying time in the air is increased so that a running speed of the runner can be increased.

In a second construction of the present invention, an elastic region is formed such that the elastic region highly rises approximately in the center of a hard plate on its surface side on which a strong load is applied to the hard plate at the time of a running movement. Further, a columnar projection attaching portion swells out and is projected in an angular shape. Accordingly, force for kicking the road surface is increased as mentioned above so that the running speed of a runner can be increased. Further, when an end tip of a projecting portion depressing the road surface, no movement of this end tip is prevented by the columnar projection attaching portion and a slip-proof property and a road surface gripping force are not reduced. Accordingly, the second construction of the present invention further contributes to the increase in running speed of the runner.

Many widely different embodiments of the present invention may be constructed without departing from the spirit and scope of the present invention. It should be understood that the present invention is not limited to the specific embodiments described in the specification, except as defined in the appended claims.

What is claimed is:

1. A shoe part for a field and track shoe having a shoe sole comprising:

a hard plate for a forefoot portion of the shoe sole, said plate including a plurality of spikes and a plurality of shorter projections terminating short of said spikes on a surface side of said hard plate;

said hard plate including an elastic region projecting from adjacent surrounding surfaces of said hard plate and lying in a central region of said surface side of said hard plate so that said elastic region lands on a road surface, prior to said adjacent surrounding surfaces, on landing of said forefoot portion thereby to provide a repulsion force from the road surface.

2. A shoe part according to claim 1 wherein said elastic region is located on a middle part of said forefoot portion which is divided into three equal parts with respect to a width direction thereof.

3. A shoe part according to claim 1, wherein said elastic region is formed by a single protuberance projecting from said hard plate.

4. A shoe part according to claim 1, wherein said elastic region is formed by at least two protuberances.

5. A shoe part according to claim 3, wherein said protuberance has a gently sloping bulbous shape.

6. A shoe part according to claim 3, wherein at least one of said spikes is disposed on a top of said protuberance.

7. A shoe part according to claim 1, wherein some of said shorter projections are disposed on said elastic region.

8. A shoe part for a field and track shoe having a shoe sole comprising:

a hard plate for a forefoot portion of said shoe sole, said hard plate including a plurality of spikes and a plurality of shorter projections terminating short of said spikes on a surface side of said hard plate;

said hard plate including an elastic region projecting from adjacent surrounding surfaces of said hard plate and lying in a central region of said surface side of said hard plate so that said elastic region lands on a road surface, prior to said adjacent surrounding surfaces, on landing of said forefoot portion thereby to increase a repulsion from the road surface, and a spike-attaching portion projecting from said adjacent surrounding surfaces on said surface side of said hard plate and having a gently sloping bulbous shape, at least some of said spikes being attached to a top portion of said spike-attaching portion.

9. A shoe part according to claim 8, wherein said elastic region is located on a middle part of said forefoot portion, said forefoot portion being divided into three equal parts with respect to a width direction thereof.

10. A shoe part according to claim 8, wherein said elastic region is formed by a single protuberance.

11. A shoe part according to claim 8, wherein said elastic region is formed by at least two protuberances.

12. A shoe part according to claim 10, wherein said protuberance has a gently sloping bulbous shape.

13. A shoe part according to claim 8, wherein a female screw member is buried in each spike-attaching portion for threadedly receiving said spike thereon.

14. A shoe part according to claim 13, wherein said spike is a bar-like member.

15. A shoe part according to claim 8, including a member having three laterally projecting flanges, said member being secured to said spike-attaching portion, and a spike projecting from each flange.

16. A shoe part according to claim 8, wherein some of said shorter projections are disposed on said spike-attaching portion.

* * * * *